US007492321B2

(12) United States Patent
Park

(10) Patent No.: US 7,492,321 B2
(45) Date of Patent: Feb. 17, 2009

(54) INTERNAL ANTENNA APPARATUS

(75) Inventor: Jung Ho Park, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 240 days.

(21) Appl. No.: 11/443,379

(22) Filed: May 30, 2006

(65) Prior Publication Data

US 2006/0267847 A1 Nov. 30, 2006

(30) Foreign Application Priority Data

May 30, 2005 (KR) ..... 10-2005-0045837

(51) Int. Cl.
*H01Q 1/24* (2006.01)

(52) U.S. Cl. ..... 343/720; 343/700 MS; 343/702; 343/795; 343/848

(58) Field of Classification Search ..... 343/700 MS, 343/702, 795, 846, 866, 895, 848
See application file for complete search history.

(56) References Cited

U.S. PATENT DOCUMENTS

| | | | | |
|---|---|---|---|---|
| 6,259,407 | B1 * | 7/2001 | Tran | 343/700 MS |
| 6,342,859 | B1 * | 1/2002 | Kurz et al. | 343/702 |
| 6,456,039 | B1 * | 9/2002 | Lauper et al. | 320/107 |
| 6,653,977 | B1 * | 11/2003 | Okabe et al. | 343/700 MS |
| 6,959,210 | B2 * | 10/2005 | Nakamura | 455/575.3 |
| 6,963,310 | B2 * | 11/2005 | Horita et al. | 343/702 |
| 7,102,578 | B2 * | 9/2006 | Minemura | 343/702 |
| 7,183,014 | B2 * | 2/2007 | Sasaki et al. | 429/7 |
| 7,339,534 | B2 * | 3/2008 | Jeong | 343/702 |
| 2002/0180651 | A1 | 12/2002 | Hareyama | |
| 2004/0095283 | A1 | 5/2004 | Park et al. | |
| 2004/0204006 | A1 | 10/2004 | Zhou et al. | |

FOREIGN PATENT DOCUMENTS

| | | |
|---|---|---|
| EP | 1 441 412 | 7/2004 |
| EP | 1 209 760 | 3/2005 |

* cited by examiner

*Primary Examiner*—Douglas W. Owens
*Assistant Examiner*—Chuc Tran
(74) *Attorney, Agent, or Firm*—The Farrell Law Firm, PC

(57) ABSTRACT

Disclosed is an internal antenna apparatus. The internal antenna allows feeding and ground connection to an antenna without power loss or degradation of performance in a structure in which a main printed circuit board is separated from the antenna. The internal antenna apparatus in a mobile communication terminal includes an antenna, a main printed circuit board, and a key pad printed circuit board, the antenna being spaced from the main printed circuit board a predetermined distance. A feeding pad is connected to the antenna, an antenna feeding part is connected between the main printed circuit board and the feeding pad, and a ground connection part connects a ground part of the main printed circuit board to a ground part of the key pad printed circuit board. The antenna feeding part includes a coaxial cable and a cable connection part. The antenna feeding part passes through a battery mounting space between the antenna and the main printed circuit board. The cable connection part is connected to the ground of the key pad printed circuit board. Accordingly, it is possible to prevent the degradation of radiation performance of the antenna.

8 Claims, 2 Drawing Sheets

INTERNAL ANTENNA APPARATUS

PRIORITY

This application claims priority to an application entitled "Internal Antenna Apparatus" filed in the Korean Intellectual Property Office on May 30, 2005 and assigned Serial No. 2005-45837, the contents of which are incorporated herein by reference.

BACKGROUND OF THE INVENTION

1. Field of the Invention

The present invention relates to an internal apparatus of a mobile communication terminal, and more particularly to an internal antenna allowing feeding and ground connection without power loss or degradation of performance in the structure of a mobile communication terminal having an antenna separated from a main printed circuit board.

2. Description of the Related Art

Mobile communication terminals such as a portable phone generally have a structure in which a main printed circuit board makes contact with and feeds an antenna through a pin of the antenna.

As mobile communication terminals have become increasingly slimmer, the mobile communication terminals have a structure in which an antenna is separated from the main print circuit board. Such a structure causes problems related to feeding or ground connection of an antenna.

In order to obtain maximum radiation performance and the radiated field of an antenna while making the terminal slimmer, it is necessary to keep the antenna away from a main printed circuit board. However, if the antenna is kept away from the main printed circuit board, power loss may result and the performance of the mobile communication terminal may be degraded.

SUMMARY OF THE INVENTION

Accordingly, the present invention has been made to solve the above-mentioned problems occurring in the prior art, and an object of the present invention is to provide an internal antenna allowing feeding and ground connection to an antenna without power loss or degradation of performance in a structure in which a main printed circuit board is separated from the antenna.

To accomplish the above and other objects, there is provided an internal antenna apparatus in a mobile communication terminal including an antenna, a main printed circuit board, and a key pad printed circuit board, the antenna being spaced from the main printed circuit board a predetermined distance, the internal antenna apparatus including a feeding pad connected to the antenna, an antenna feeding part connected between the main printed circuit board and the feeding pad, and a ground connection part for connecting a ground part of the main circuit board to a ground part of the key pad printed circuit board. The antenna feeding part includes a coaxial cable and a cable connection part. The antenna feeding part passes through an antenna mounting space between the antenna and the main printed circuit board. The cable connection part is connected to the ground of the key pad printed circuit board. Accordingly, it is possible to prevent the degradation of radiation performance of the antenna.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Figure 1:
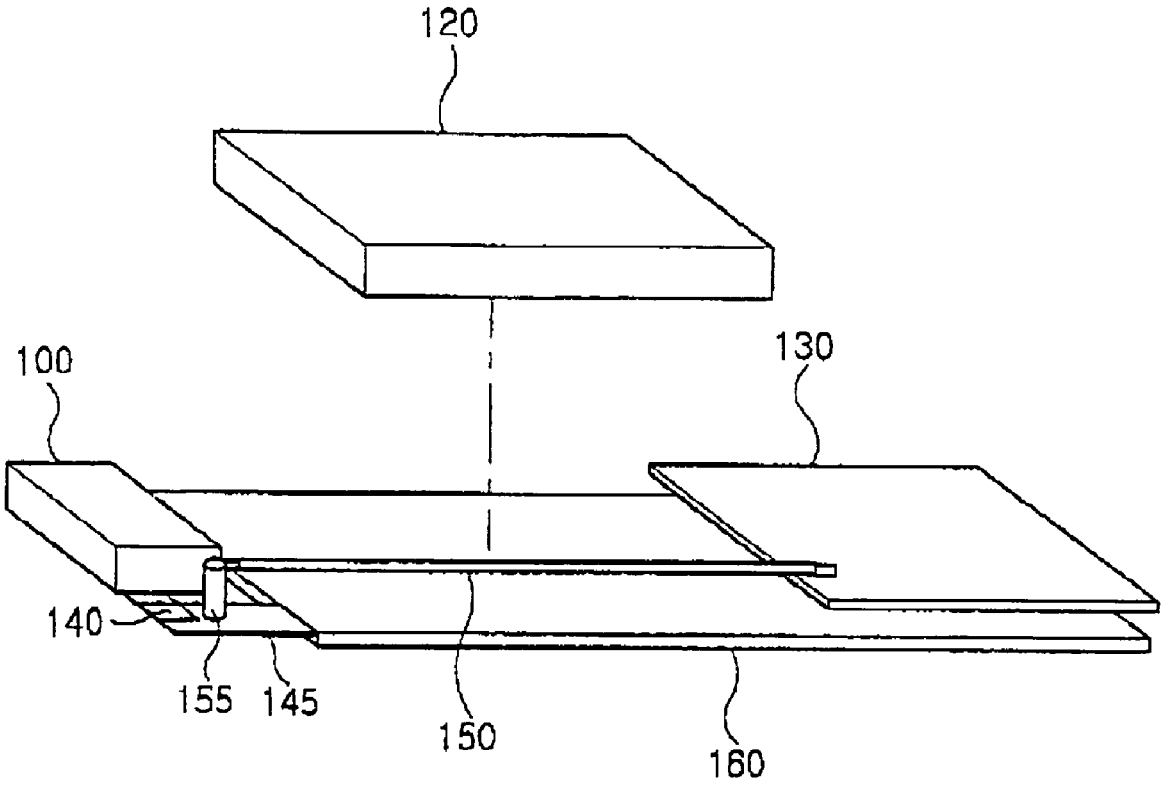
FIG. 1 is a first perspective view illustrating the structure of a mobile communication terminal having an antenna separated from a printed circuit board (PCB) according to the present invention.

Hereinafter, preferred embodiments of the present invention will be described in detail with reference to the accompanying drawings. Note that the same or similar components in drawings are designated by the same reference numerals as far as possible although they are shown in different drawings. Also, hereinafter, specific items such as components of a detailed circuit will be given. However, these specific items will be given only in order to overall understand the present invention. Therefore, it should be apparent to those skilled in the art that the present invention can be realized without such specific items. In the following description of the present invention, a detailed description of known functions and configurations incorporated herein will be omitted when it may make the subject matter of the present invention unclear.

Figure 2:
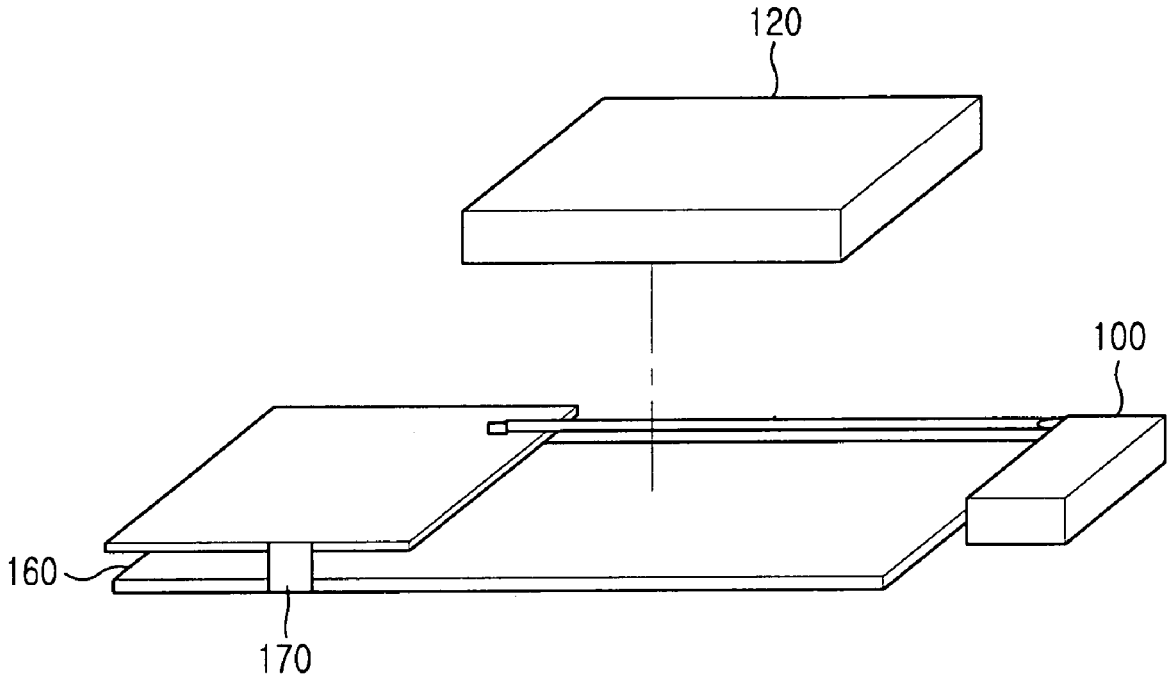
FIG. 2 is a second perspective view illustrating the structure of a mobile communication terminal having an antenna separated from a printed circuit board (PCB) according to the present invention.

FIG. 1 is a first perspective view illustrating the structure of a mobile communication terminal having an antenna separated from a printed circuit board (PCB) from one side, and FIG. 2 is a second perspective view illustrating the structure of a mobile communication terminal having an antenna separated from a printed circuit board (PCB) from a rear side with respect to FIG. 1, according to the present invention.

An antenna 100 is separated from a main PCB 130 by a predetermined distance. A battery 120 may be mounted in a space formed through the separation of the antenna 100 and the main PCB 130.

The main PCB 130 is vertically spaced from a key pad PCB 160 by a predetermined distance. A ground connection part 170 as shown in FIG. 2 connects a ground part of the main PCB 130 to a ground part of the key pad PCB 160. This ground connection part 170 may be realized using a data cable. In other words, the main PCB 130 can recognize key input data sent from the key pad PCB 160 by means of the data cable connected between the main PCB 130 and the key pad PCB 160. This data cable may serve as a ground part.

A feeding pad 140 is connected to the antenna 100, and an antenna feeding part 150 is connected between the main PCB 130 and the feeding pad 140. The antenna feeding part 150 may be realized using a thin coaxial cable and a cable connection part. The antenna feeding part 150 passes through the battery mounting space between the antenna 100 and the main PCB 130.

A cable connection part 155 is designed to be attachable to a slice PCB 145 which allows feeding pad 140 to be installed thereon and is connected to the ground part of the key pad 160. As shown in FIG. 1, this slice PCB 145 may be realized in such a manner that it is extended from the key pad PCB 160, or may be realized to be integral with the antenna 100.

If only a coaxial cable exists, the coaxial cable may act as a radiator so as to cause the radiation performance of a mobile communication terminal to be seriously degraded. For this reason, if the cable connection part 155 is connected to the ground part of the key pad PCB 160, the coaxial cable does not seriously cause the radiation performance to be degraded.

As described above, according to the present invention, feeding and ground connection can be achieved without degradation of the performance or power loss in a slim-type mobile communication terminal having an antenna separated from a main PCB.

While the invention has been shown and described with reference to certain preferred embodiments thereof, it will be understood by those skilled in the art that various changes in form and details may be made therein without departing from the spirit and scope of the invention. Consequently, the scope of the invention should not be limited to the embodiments, but should be defined by the appended claims and equivalents thereof.

What is claimed is:

1. An internal antenna apparatus in a mobile communication terminal including an antenna, a main printed circuit board, and a key pad printed circuit board, the antenna being spaced from the main printed circuit board a predetermined distance, the internal antenna apparatus comprising:

a feeding pad connected to the antenna;

an antenna feeding part connected between the main printed circuit board and the feeding pad, the antenna feeding part passing through a battery mounting space between the antenna and the main printed circuit board; and a ground connection part for connecting a ground part of the main printed circuit board to a ground part of the key pad printed circuit board.

2. The internal antenna apparatus as claimed in claim 1, wherein the antenna feeding part includes a coaxial cable and a cable connection part.

3. The internal antenna apparatus as claimed in claim 2, wherein the cable connection part is connected to a ground of the key pad printed circuit board.

4. The internal antenna apparatus as claimed in claim 2, wherein the cable connection part is attachable to a slice printed circuit board extending from the key pad printed circuit board.

5. The internal antenna apparatus as claimed in claim 2, wherein a slice printed circuit board is integral with the antenna, and the cable connection part is attachable to the slice printed circuit board and is connected to a ground of the key pad printed circuit board.

6. The internal antenna apparatus as claimed in claim 4, wherein the feeding pad is installed on the slice-printed circuit board.

7. The internal antenna apparatus as claimed in claim 5, wherein the feeding pad is installed on the slice-printed circuit board.

8. The internal antenna apparatus as claimed in claim 1, wherein the ground connection part is a data cable connected between the main printed circuit board and the key pad printed circuit board.

* * * * *